US005618206A

United States Patent [19]

Sawada et al.

[11] Patent Number: 5,618,206

[45] Date of Patent: Apr. 8, 1997

[54] WATERPROOF CONNECTOR HAVING A CONNECTOR HOUSING WITH A PLURALITY OF TERMINAL ACCOMMODATION CHAMBERS AND A SEAL HOOD

[75] Inventors: Yoshitsugu Sawada; Toshihiko Masuda, both of Shizuoka-ken, Japan

[73] Assignee: Yazaki Corporation, Tokyo, Japan

[21] Appl. No.: 547,559

[22] Filed: Oct. 24, 1995

[30] Foreign Application Priority Data

Oct. 24, 1994 [JP] Japan ..... 6-258230
Mar. 20, 1995 [JP] Japan ..... 7-061093

[51] Int. Cl.[6] ..... H01R 13/40

[52] U.S. Cl. ..... 439/587; 439/274

[58] Field of Search ..... 439/587, 589, 439/274, 275, 279

[56] References Cited

U.S. PATENT DOCUMENTS

| | | | |
|---|---|---|---|
| 4,711,509 | 12/1987 | Cross et al. | 439/587 |
| 5,145,410 | 9/1992 | Maejima et al. | 439/587 |
| 5,151,045 | 9/1992 | Cravens et al. | 439/271 |
| 5,240,433 | 8/1993 | Kato | 439/587 |
| 5,266,045 | 11/1993 | Yamamoto et al. | 439/275 |

FOREIGN PATENT DOCUMENTS

| | | |
|---|---|---|
| 62-26879 | 2/1987 | Japan . |
| 4-58975 | 5/1992 | Japan . |
| 5-205810 | 8/1993 | Japan . |

*Primary Examiner*—P. Austin Bradley
*Assistant Examiner*—Barry Matthew L. Standig
*Attorney, Agent, or Firm*—Oblon, Spivak, McClelland, Maier & Neustadt, P.C.

[57] ABSTRACT

A waterproof connector comprises: a connector housing (29, 89) formed with a plurality of terminal accommodation chambers (27, 93) for accommodating a plurality of terminal parts (53, 117), respectively and with a seal hood portion (39, 105); and a sealing member (25, 91) fitted to the seal hood portion of the housing and formed with a plurality of seal locating projections (47, 109) each having an insertion hole (45, 107) at a center thereof. A plurality of terminal parts (53, 117) connected to wires (51, 115), respectively are inserted into the terminal accommodation chambers of the housing, through the wire insertion holes of the sealing member fitted to the seal hood portion of the housing, respectively under watertight conditions. Owing to the presence of the seal locating projections (47, 109), the wire insertion holes of the sealing member are not dislocated away from the openings of the terminal accommodating chambers of the housing, when the terminal parts are inserted into the connector housing, thus improving the assembly productivity without increasing the number of parts.

5 Claims, 5 Drawing Sheets

WATERPROOF CONNECTOR HAVING A CONNECTOR HOUSING WITH A PLURALITY OF TERMINAL ACCOMMODATION CHAMBERS AND A SEAL HOOD

BACKGROUND OF THE INVENTION

Field of the Invention

The present invention relates to a waterproof connector, and more specifically to a waterproof connector having a housing formed with a plurality of terminal accommodation chambers and an elastic sealing member (e.g., made of rubber) fitted to a seal hood portion of the housing to seal the terminal accommodation chambers.

Description of the Related Art

A first example of the waterproof connector is disclosed in Japanese Published Unexamined (Kokai) Patent Application No. 5-205810. The disclosed waterproof connector is composed of a housing formed with a plurality of terminal accommodation chambers, an elastic sealing member attached to the housing from the connector rear side, and a cap for fixing the sealing member to the housing. Further, a spacer is attached to the housing from a connector front side for prevention of removal of terminals accommodated in the housing. In this waterproof connector, a plurality of terminal parts connected to wires are inserted into a plurality of terminal accommodation chambers of the housing through insertion holes formed in the cap and the elastic sealing member, respectively. In this case, there exists a problem in that when the terminal parts are inserted into the elastic sealing member, the insertion holes formed in the elastic sealing member are easily dislocated away from the openings of the terminal accommodation chamber, so that the terminal insertion holes of the housing and the sealing member do not match. To overcome this problem, a plurality of ribs are formed on the inner side of the cap to fix the elastic sealing member by the cap. In this method, however, there arises another problem in that the number of parts and the thickness of the cap (i.e., the connector size) both increase.

A second example of the waterproof connector is disclosed in Japanese Published Unexamined (Kokai) Utility Model Application No. 4-58975, in which no cap is provided. This waterproof connector is composed of a connector housing formed with a plurality of lattice-shaped walls to form a plurality of the terminal accommodation chambers, separately on the rear side of the housing, and a sealing member formed with a plurality of square projections each fitted into each separated terminal accommodation chamber. In this connector, since the sealing member is inserted into each separated terminal accommodation chamber, the sealing member will not be dislocated away from the terminal accommodation chamber, so that the terminal insertion holes of the housing and the sealing member match well. In this connector, however, since a circular wire insertion hole is formed in each square projection of the sealing member, the wall thickness of the sealing member is not uniform around the wire insertion hole formed in the sealing member, so that when the wire is inserted into the wire insertion hole, the sealing member wall cannot be deformed uniformly, with the result that there arises a problem in that the wire cannot be tightly sealed by the sealing member uniformly around the wire.

A third example of the waterproof connector is disclosed in Japanese Published Unexamined (Kokai) Utility Model Application No. 62-26879, in which no cap is also provided. This waterproof connector is composed of a connector housing formed with a plurality of circular terminal accommodation chambers and a plurality of separate cylindrical sealing members, in such a way that each cylindrical sealing member is inserted into each terminal accommodation chamber, individually. In this waterproof connector, since the wall thickness of each sealing member is uniform around each wire insertion hole thereof, the wire can be uniformly and stably sealed by the sealing member. On the other hand, however, since a plurality of the cylindrical sealing members must be inserted into a plurality of the terminal accommodation holes of the housing one by one, the assembly work is troublesome and thereby the workability is low.

SUMMARY OF THE INVENTION

With these problems in mind, therefore, it is the object of the present invention to provide a waterproof connector, which can prevent the wire insertion holes of the sealing member from being dislocated away from the openings of the terminal accommodation chambers of the connector housing, while improving the assembly workability of the waterproof connector without increasing the number of parts.

To achieve the above-mentioned object, the present invention provides a waterproof connector, comprising: a connector housing (29, 89) formed with a plurality of terminal accommodation chambers (27, 93) for accommodating a plurality of terminal parts (53, 117), respectively and with a seal hood portion (39, 105); and a sealing member (25, 91) fitted to the seal hood portion of said housing and formed with a plurality of seal locating projections (47, 109) each having an insertion hole (45, 107) at a center thereof, a plurality of terminal parts (53, 117) connected to wires (51, 115), respectively being inserted into the terminal accommodation chambers of said housing through the wire insertion holes of said sealing member fitted to the seal hood portion of said housing, respectively under watertight conditions.

Here, it is preferable that each of the terminal accommodation chambers (27, 93) of said housing is formed into a cylindrical shape, and each of the seal locating projections (47, 109) of said sealing member is formed into an annular shape fitted into the terminal accommodation chamber together with the terminal part, respectively.

Further, it is preferable that said sealing member (25, 91) is formed with a plurality of outer lip portions (43, 103) for sealing a space between said housing and said sealing member. Further, it is preferable that each of the seal locating projections (47, 109) of said sealing member (25, 91) is formed with at least one inner lip portion (57, 108) for sealing a space between said sealing member and the wire (51, 115).

Further, it is also preferable that each of the terminal accommodation holes (93) is formed with an inner small-diameter portion (93*a*) for accommodating each terminal part (117) and an outer large-diameter opening portion (101) at a bottom of the seal hood portion (105) of said housing to accommodate each seal locating projection (109).

Further, it is preferable that said sealing member (25) is formed with a plurality of cutout portions (49) engaged with a plurality of seal lock claws (41) formed at the seal hood portion (39) of said housing (29).

In the waterproof connector according to the present invention, since the seal locating projections are formed in the sealing member, when the terminal parts connected to wire are inserted into the connector housing through the sealing member, it is possible to prevent the sealing member from being dislocated from the openings of the terminal accommodation chambers of the housing, so that the assembly workability can be improved. Further, since the annular seal locating projections each having a uniform wall-thickness are formed in the sealing member, the sealing member can be deformed uniformly, so that the tightness between the outer circumference of the wire and the inner circumference of the wire insertion hole of the sealing member can be uniformalized, thus improving the sealing characteristics. Further, since a plurality of outer or inner lip portions are formed in the sealing member, it is possible to seal the space between the housing and the sealing member and the space between the sealing member and the wire, both more securely.

DETAILED DESCRIPTION OF THE EMBODIMENTS

Embodiments of the waterproof connector according to the present invention will be described in detail hereinbelow with reference to the attached drawings.

First embodiment

Figure 1:
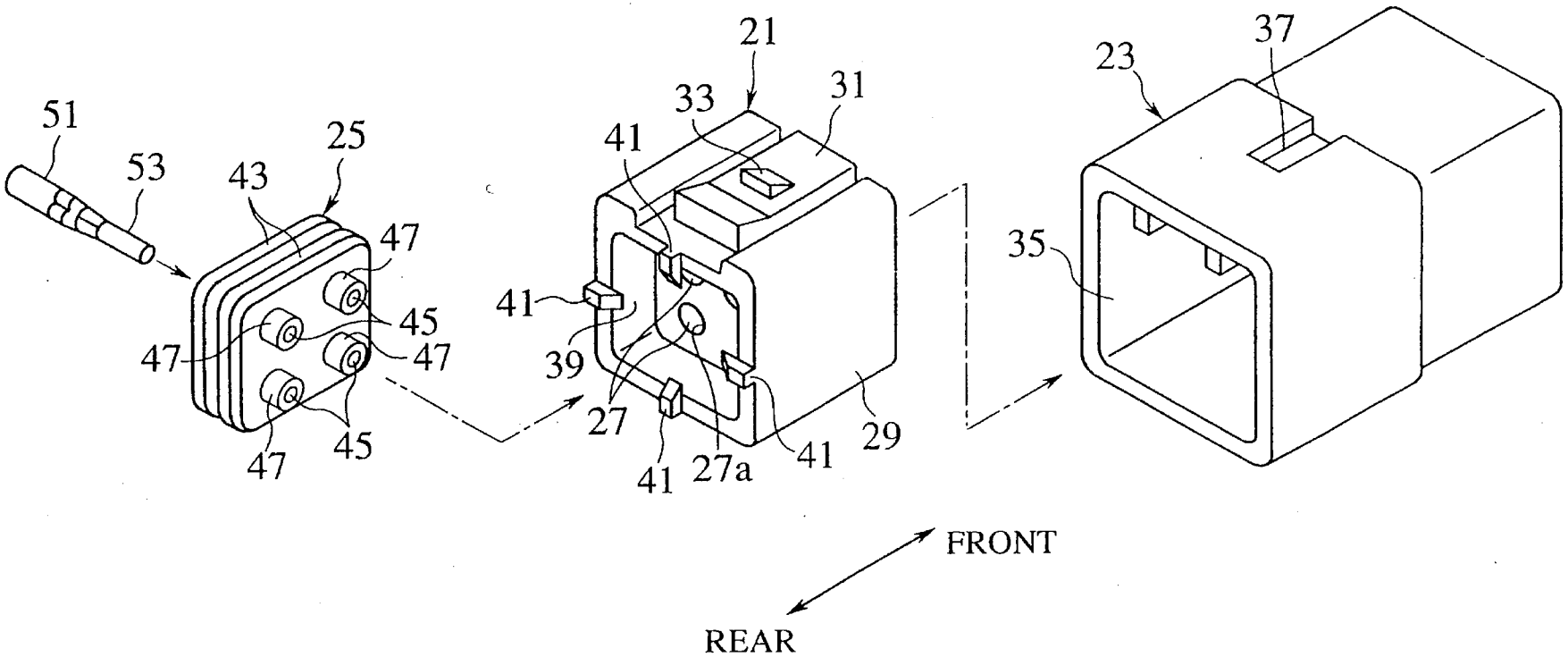
FIG. 1 is an exploded view showing a first embodiment of the waterproof connector according to the present invention and a mated connector thereof.
Figure 2:
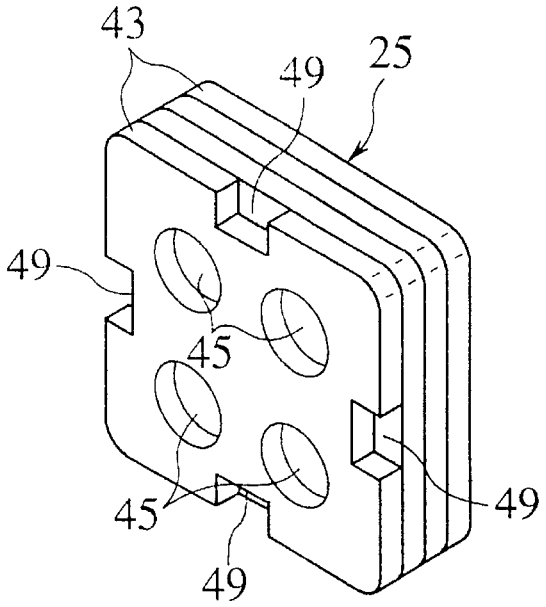
FIG. 2 is a perspective view showing a sealing member of the first embodiment of the waterproof connector according to the present invention.

In FIG. 1, a waterproof connector 21 of the present invention is mated with a mated connector 23. The waterproof connector 21 is composed of a connector housing 29 and a elastic sealing member 25 formed of a rubber, for instance. The housing 29 is formed with a seal hood portion 39 (at the rear end) and four terminal accommodation chambers 27 arranged two by two at two rows. The sealing member 25 is attached to the seal hood portion 39 of the housing 29 to seal a plurality of terminal parts connected to wires and inserted into the terminal accommodation chambers of the housing 29.

Further, the housing 29 is formed with a flexible lock arm 31 on the upper side surface thereof and with an engage projection 33 at an intermediate portion of the lock arm 31. Therefore, when the housing 29 is fitted to a hood portion 35 of the mated connector 23, the engage projection 33 is engaged with an engage hole 37 formed in the hood portion 35 of the mated connector 23, so that the waterproof connector 21 can be coupled with the mated connector.

Further, the housing 29 is formed with a four claws 41 at the opening edge portion of the seal hood portion 39 so as to project inward for engagement with the sealing member 25 fitted to the seal hood portion 39 of the housing 29. Therefore, the sealing member 25 can be prevented from being removed from the seal hood portion 39 of the housing 29.

The sealing member 25 is formed into a rectangular plate shape and formed of a soft elastic material such as synthetic rubber, for instance. Further, two outer lip portions 43 are formed being arranged in parallel to each other so as to extend all over the outer side surfaces of the sealing member 25. When the sealing member 25 is fitted to the seal hood portion 39 of the housing 29, these lip portions 43 are brought into tight contact with the inner wall of the seal hood portion 39 of the housing 29 for sealing.

Figure 3:
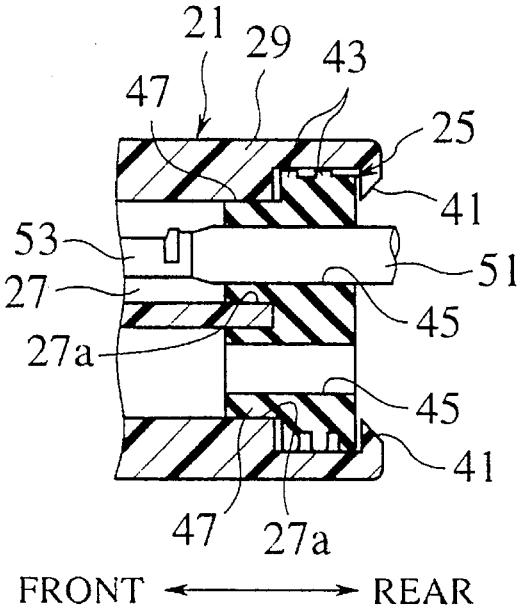
FIG. 3 is a partial cross-sectional view showing the state where the sealing member is attached to the connector housing of the first embodiment of the waterproof connector.

As shown in FIGS. 1 and 3, the sealing member 25 is formed with four seal locating projections 47 so as to be inserted into the four terminal accommodation chambers 27 from the rear end openings 27*a* of the terminal accommodation chambers 27 of the housing 29, respectively. Further, a wire insertion hole 45 is formed at the center of each seal locating projection 47. Therefore, when the sealing member 25 is fitted to the rear end seal hood portion 39 of the housing 29, each wire insertion hole 45 can well communicate with each rear end opening 27*a* of each terminal accommodation chamber 27. Further, the outer lip portions 43 of the sealing member 25 are formed with four cutout portions 49 engaged with the lock claws 39 of the seal hood portion 39 of the housing 29 when the sealing member 25 is fitted to the housing 29.

In assembly, when the sealing member 25 is assembled with the housing 29, first the sealing member 25 is fitted to the seal hood portion 39 of the housing 29, and then the four cylindrical seal locating projections 47 are inserted into the four terminal accommodation chambers 27, respectively. Further, the four lock claws 41 are engaged with the four cutouts portions 49 of the outer lip portion 43 of the sealing member 25 (shown in FIG. 3). Under these conditions, the sealing member 25 can be securely fitted to the seal hood portion 39 of the housing 29 on the rear (wire lead-out) side of the housing 29.

Under these conditions, a terminal part 53 fixed to a wire 51 is pushed from the rear side of the sealing member 25, through the wire insertion hole 45 of the seal locating projection 47 of the sealing member 25, into the terminal accommodation chamber 27 of the housing 29. When the terminal part 53 is being inserted into the accommodation chamber 27 of the housing 29, since the sealing member 25 can be securely held within the seal hood portion 39 of the housing 29 by the presence of the four seal locating projections 47 inserted into the terminal accommodation chambers 27, respectively, the insertion holes 45 of the sealing member 25 well match the openings 27*a* of the terminal accommodation chambers 27, respectively. Therefore, each wire 51 can be brought into tight contact with the inner surface of each insertion hole 45 of the sealing member 25 and further into each terminal accommodation chamber 27, so that it is possible to securely seal the space between the outer circumference of the wire 51 and the inner circumference of the insertion hole 45 of the sealing member 25.

In the waterproof connector according to the present invention, when the wire 51 is inserted into the wire insertion hole 45 of the sealing member 25, the sealing member 25 tends to be deformed by the inserted wire 51. In this case, however, since the cylindrical seal locating projections 47 are fitted to the terminal accommodation chambers 27, it is possible to prevent the four adjacent wire insertion holes 45 from being dislocated from the openings 27*a* of the terminal accommodation chambers 27 of the housing 29. As a result, the terminal part 53 can be easily inserted into the terminal accommodation chambers 27 through the wire insertion holes 45 of the sealing member 25, so that the assembly workability can be improved.

In addition, in the waterproof connector according to the present invention, since the wire insertion holes 45 of the sealing member 25 can be securely prevented from being dislocated from the openings 27*a* of the terminal accommodation chambers 27, any sealing member pushing member (e.g., cap) for preventing the deformation of the sealing member is not required, so that the number of parts can be reduced.

Further, in the waterproof connector according to the present invention, since the terminal accommodation chamber 27 is formed into a circular shape in cross section and further since the cylindrical seal locating projection 47 of the sealing member 25 is formed into an annular shape in cross section, the wall thickness of the sealing member 25 is substantially uniform in the radial direction from the rear end to the front end thereof, so that it is possible to deform the sealing member 25 in the radial direction roughly uniformly whenever the wire 51 is inserted into the insertion hole 45 of the sealing member 25. As a result, the contact force between the wire 51 and the wire insertion hole 45 of the sealing member 25 is roughly uniform along the circumferential direction of the sealing member 25, thus providing a high sealing characteristics.

Further, when the sealing member 25 is fitted to the seal hood portion 39 of the housing 29, since a plurality of terminal accommodating chambers 27 can be sealed by the sealing member 25 by only a single action; that is, since the sealing members 25 are not inserted into the terminal accommodation chambers 27 one by one, the assembly workability can be increased.

Figure 4:
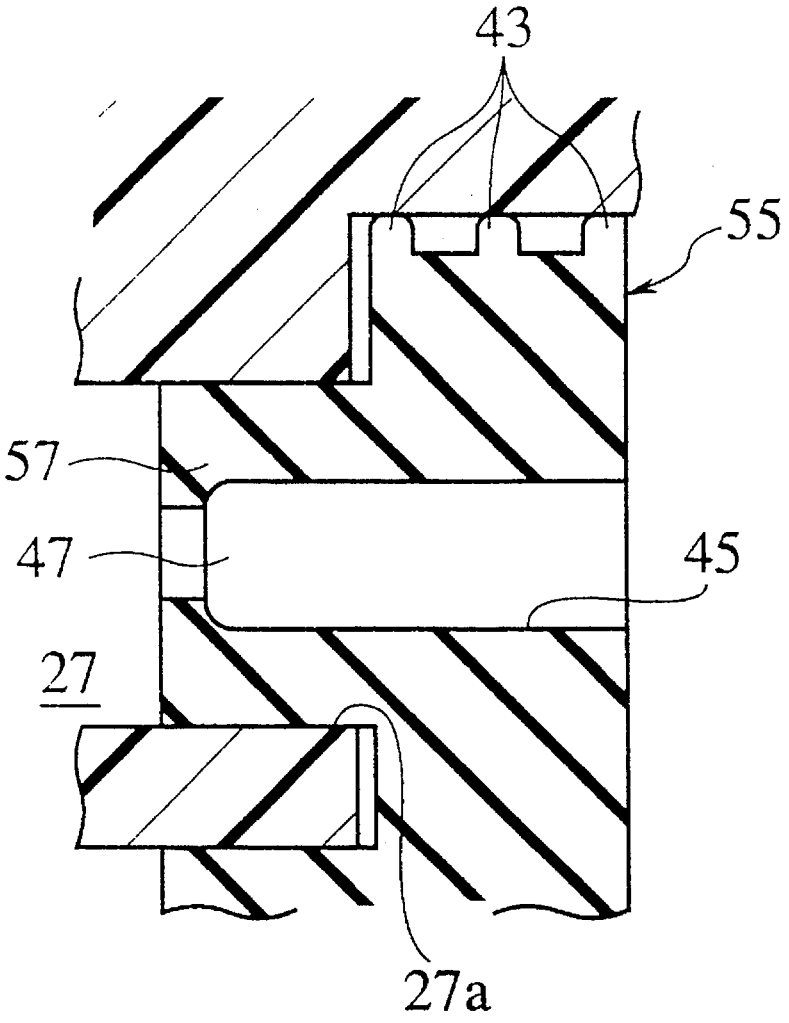
FIG. 4 is an enlarged partial cross-sectional view showing the state where the sealing member is attached to the connector housing of a modification of the first embodiment of the waterproof connector according to the present invention.

FIG. 4 shows a modification of the first embodiment. In this modification, the sealing member 55 is formed with the three outer lip portions 43 to seal the space between the outer side surface of the sealing member 55 and the inner side surface of the housing 29. In addition, the cylindrical seal locating projection 47 of the sealing member 55 is formed with an inner lip portion 57 to seal the space between the outer circumference of the wire 51 and the inner circumference of the cylindrical seal locating projection 47. In this modification, it is possible to more securely seal the wire 51 by the sealing member 55.

Further, in the above description, although the lock claws 41 are formed as means for fixing the sealing member 25 to the housing 29, it is possible to adopt another locking means.

Second embodiment

Figure 5:
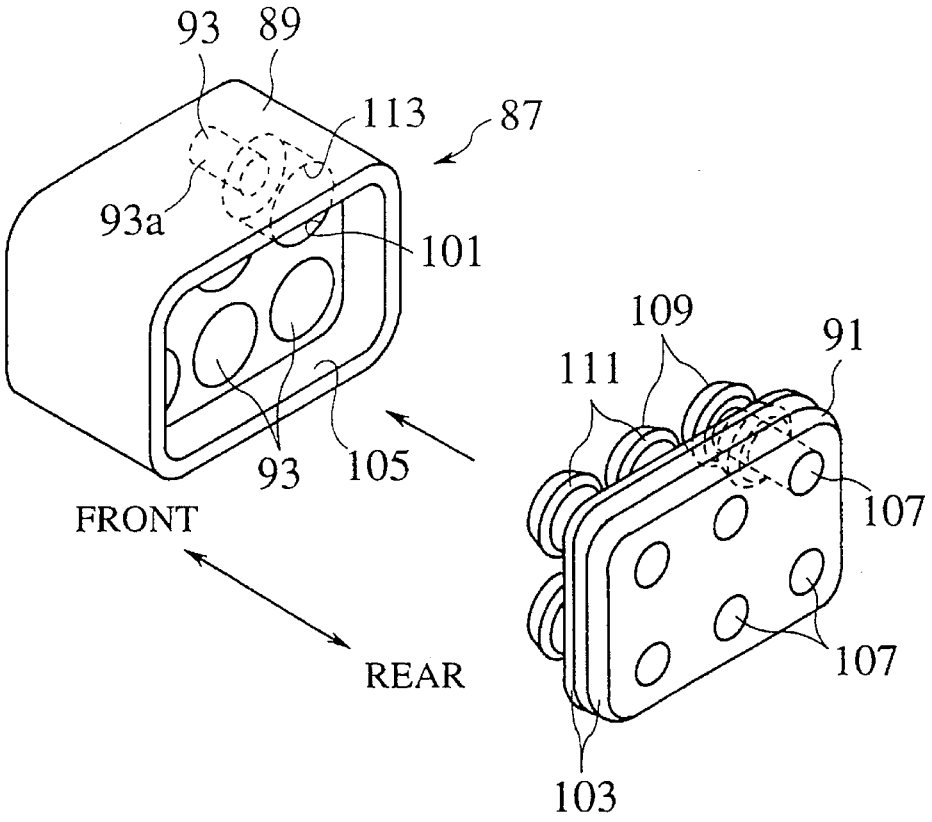
FIG. 5 is an exploded view showing a second embodiment of the waterproof connector according to the present invention.

In FIG. 5, a waterproof connector 87 of the present embodiment is composed of a connector housing 89 and an elastic sealing member 91. The housing 89 is formed with six terminal accommodation chambers 93 arranged three by three at two rows and with a seal hood portion 105. The sealing member 91 is attached to the rear end seal hood portion 105 of the housing 89 to seal a plurality of terminal parts 117 inserted into the six terminal accommodation chambers 93 of the housing 89.

Figure 7:
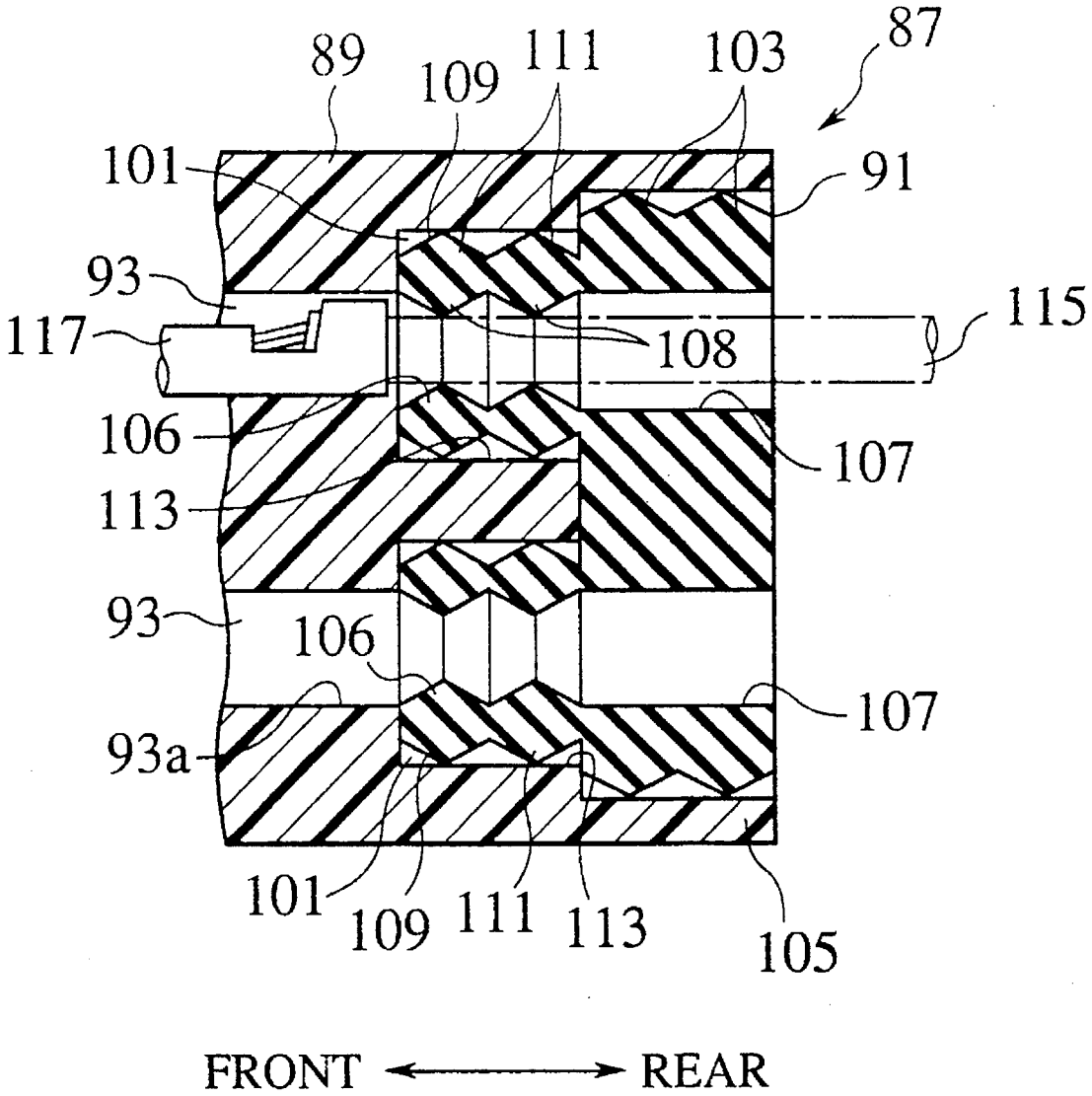
FIG. 7 is an enlarged cross-sectional view showing the assembly relationship between a housing and the sealing member of the second embodiment of the waterproof connector.

Further, as shown in FIGS. 5 and 7, the terminal accommodation chamber 93 is formed with an inner small diameter portion 93*a* for accommodating each terminal part 117 and an outer large-diameter opening portion 101 for accommodating each cylindrical seal locating projection 109. That is, the sealing member 91 is fitted to the seal hood portion 105 of the housing 89, and the cylindrical projection 109 of the sealing member 91 is fitted to the large-diameter opening portion 101, as shown in FIG. 7.

The sealing member 91 is formed into a rectangular plate shape and formed of a soft elastic material such as synthetic rubber, for instance. Further, two triangular cross-section outer lip portions 103 are formed being arranged in parallel to each other so as to extend all over the outer end surfaces of the sealing member 91. When the sealing member 91 is fitted to the seal hood portion 105 of the housing 89, these outer lip portions 103 are brought into tight contact with the inner wall of the seal hood portion 105 of the housing 89.

Figure 6A:
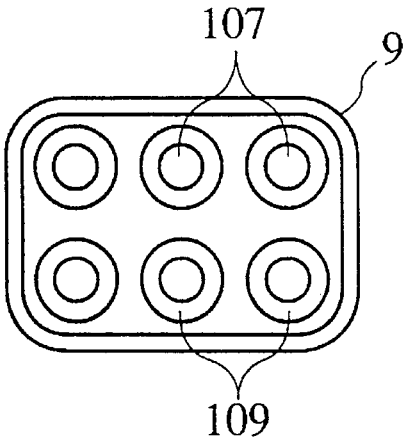
FIG. 6A is a front view showing the sealing member of the second embodiment of the waterproof connector.
Figure 6B:
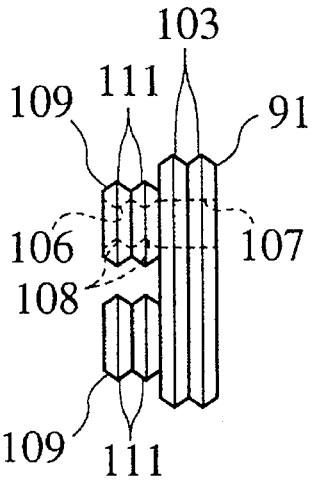
FIG. 6B is a side view showing the same sealing member of the second embodiment of the waterproof connector.

As shown in FIGS. 5, 6A and 6B, the sealing member 91 is formed with six cylindrical seal locating projections 109 so as to be inserted into the large-diameter openings 101 of the six terminal accommodation chambers 93 of the housing 89. Further, a wire insertion hole 106 is formed at the center of each cylindrical seal locating projection 109. Therefore, when the sealing member 91 is fitted to the rear end seal hood portion 105 of the housing 89, each wire insertion hole 106 can communicate with the terminal accommodation chamber 93 of the housing 89 under excellent conditions.

Here, the outer diameter of the cylindrical seal locating projection 109 is formed slightly larger than the inner diameter of the large-diameter opening portion 101 of the terminal accommodation chamber 93 of the housing 89. Further, the cylindrical projection 109 is formed with two outer triangular cross-section lip portions 111 to seal the space between the outer circumference of the cylindrical seal locating projection 109 and the inner wall 113 of the cylindrical projection accommodation portion 101. In addition, the cylindrical projection 109 is formed with two inner triangular cross-section lip portions 108 to seal the space between the inner circumference of the cylindrical seal locating projection 109 and the outer circumference of the wire 115.

In assembly, when the sealing member 91 is fitted to the housing 89, first the sealing member 91 is fitted to the seal hood portion 105 of the housing 89, and then the six cylindrical seal locating projections 109 are inserted into the six large-diameter openings 101 of the terminal accommodation chambers 93, respectively. Under these conditions, the sealing member 91 can be securely fitted to the rear side (wire lead-out side) hood portion 105 of the housing 89 by the presence of the six cylindrical seal locating projections 109.

Under these conditions, a terminal part 117 fixed to a wire 115 is pushed from the rear side of the sealing member 91, through the wire insertion hole 107 of the sealing member 91, into the terminal accommodation chamber 93 of the housing 89. When the terminal part 117 is inserted into the accommodation chamber 93 of the housing 89, since the wire 115 can be brought into tight contact with the inner surface of the insertion hole 107 of the sealing member 91, it is possible to securely seal the space between the outer circumference of the wire 115 and the inner circumference of the insertion hole 107 of the sealing member 91.

In the waterproof connector according to the present invention, when the wire 115 is inserted into the wire insertion hole 107 and 106 of the sealing member 91, the sealing member 91 tends to be deformed by the inserted wire 115. In this case, however, since the cylindrical seal locating projection 109 is fitted to the cylindrical large-diameter opening portion 101, it is possible to prevent the six adjacent wire insertion holes 107 and 106 from being dislocated away from the small-diameter portions 93*a* of the terminal accommodation chambers 93 of the housing 89. As a result, the terminal part 117 can be easily inserted into the wire insertion hole 107 of the sealing member 91, so that the assembly workability can be improved.

Further, in the waterproof connector according to the present invention, since the terminal accommodation chamber 93 is formed into a circular shape in cross section and further since the cylindrical seal locating projection 109 of the sealing member 91 is formed into an annular shape in cross section, the wall thickness of the sealing member 91 is substantially uniform in the radial direction from the rear side to the front side of the sealing member 91, so that it is possible to deform the sealing member 91 in the radial direction roughly uniformly whenever the wire 115 is inserted into the insertion hole 107 of the sealing member 91. As a result, the contract force between the wire 115 and the wire insertion hole 107 of the sealing member 91 is roughly uniform along the circumferential direction of the sealing member 91, thus providing a high sealing characteristics.

In addition, in the waterproof connector according to the present invention, since it is possible to securely prevent the wire insertion hole 107 of the sealing member 91 from being dislocated away from the small-diameter portion 93*a* of the terminal accommodation chamber 93, any sealing member pushing member (e.g., cap) for preventing the deformation of the sealing member 91 is not required, so that the number of parts can be reduced Further, when the sealing member 91 is fitted to the seal hood portion 105 of the housing 89, since a plurality of terminal accommodating chambers 93 can be sealed by the sealing member 91 by only a single action; that is, since the sealing member 91 is not inserted into the terminal accommodation chamber one by one, the assembly workability can be increased.

As described above, in the waterproof connector according to the present invention, since the seal locating projections are formed in the sealing member, when the terminal parts connected to wire are inserted into the connector housing through the sealing member, it is possible to prevent the sealing member from being dislocated from the openings of the terminal accommodation chambers of the housing, so that the assembly workability can be improved.

Further, since the annular seal locating projections each having a uniform wall-thickness are formed in the sealing member, the sealing member can be deformed uniformly, so that the tightness between the outer circumference of the wire and the inner circumference of the wire insertion hole of the sealing member can be uniformalized, thus improving the sealing characteristics.

Further, since a plurality of outer or inner lip portions are formed in the sealing member, it is possible to seal the space between the housing and the sealing member and the space between the sealing member and the wire, both more securely.

What is claimed is:

1. A waterproof connector, comprising:

a connector housing formed with a plurality of terminal accommodation chambers for accommodating a plurality of terminal parts, respectively and with a seal hood portion; and a sealing member fitted to the seal hood portion of said housing and formed with a plurality of seal locating projections each having an insertion hole at a center thereof;

the plurality of terminal parts connected to wires, respectively being inserted into the terminal accommodation chambers of said housing through the wire insertion holes of said housing, respectively under watertight conditions, wherein each of the terminal accommodation chambers of said housing is formed into a cylindrical shape, and each of the seal locating projections of said sealing member is formed into an annular shape fitted into the terminal accommodation chamber together with the terminal part, respectively.

2. The waterproof connector of claim 1, wherein said sealing member is formed with a plurality of outer lip portions for sealing a space between said housing and said sealing member.

3. The waterproof connector of claim 1, wherein each of the seal locating projections of said sealing member is formed with at least one inner lip portion for sealing a space between said sealing member and the wire.

4. The waterproof connector of claim 1, wherein each of the terminal accommodation holes is formed with an inner small-diameter portion for accommodating each terminal part and an outer large-diameter opening portion at a bottom of the seal hood portion of said housing to accommodate each seal locating projection.

5. A waterproof connector, comprising:

a connector housing formed with a plurality of terminal accommodation chambers for accommodating a plurality of terminal parts respectively and with a seal hood portion; and a sealing member fitted to the seal hood portion of said housing and formed with a plurality of seal locating projections each having an insertion hole at a center thereof;

the plurality of terminal parts connected to wires, respectively being inserted into the terminal accommodation chambers of said housing through the wire insertion holes of said housing, respectively under watertight conditions, wherein said sealing member is formed with a plurality of cutout portions engaged with a plurality of seal lock claws formed at the seal hood portion of said housing.

* * * * *